US012320126B2

(12) United States Patent
Chich et al.

(10) Patent No.: US 12,320,126 B2
(45) Date of Patent: Jun. 3, 2025

(54) ROOFING MEMBRANE AND ASSOCIATED ROOFING SYSTEM AND METHOD

(71) Applicant: BMIC LLC, Dallas, TX (US)

(72) Inventors: Adem Chich, Kearny, NJ (US); Yan Zheng, Parsippany, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/796,909

(22) Filed: Aug. 7, 2024

(65) Prior Publication Data

US 2025/0052063 A1 Feb. 13, 2025

Related U.S. Application Data

(60) Provisional application No. 63/518,015, filed on Aug. 7, 2023.

(51) Int. Cl.

| | |
|---|---|
| ***E04B 1/00*** | (2006.01) |
| ***E04D 5/10*** | (2006.01) |
| ***E04D 5/14*** | (2006.01) |

(52) U.S. Cl.

CPC ..... *E04D 5/142* (2013.01); *E04D 5/10* (2013.01); *E04D 5/148* (2013.01)

(58) Field of Classification Search

CPC ..... E04D 5/142; E04D 5/10; E04D 5/148

See application file for complete search history.

(56) References Cited

U.S. PATENT DOCUMENTS

| | | | | |
|---|---|---|---|---|
| 4,530,868 | A * | 7/1985 | Shinmi | A41D 27/24 428/920 |
| 4,569,870 | A * | 2/1986 | Shinmi | B29C 65/62 156/92 |
| 4,588,637 | A * | 5/1986 | Chiu | E04D 5/148 428/521 |
| 4,668,315 | A | 5/1987 | Brady et al. | |
| 4,683,165 | A * | 7/1987 | Lindemann | C08L 31/04 442/164 |
| 4,855,172 | A * | 8/1989 | Chiu | C09J 123/22 428/521 |
| 5,095,068 | A * | 3/1992 | Chiu | E04D 5/142 525/232 |
| 5,204,148 | A * | 4/1993 | Alexander | E04D 5/145 52/514 |
| 5,283,592 | A * | 2/1994 | Bogorad | B64G 1/54 343/DIG. 2 |
| 5,348,788 | A * | 9/1994 | White | A61L 27/56 428/338 |
| 6,679,018 | B2 | 1/2004 | Georgeau et al. | |
| 2002/0102422 | A1* | 8/2002 | Hubbard | E04D 5/142 428/517 |
| 2004/0157074 | A1* | 8/2004 | Hubbard | C09J 7/29 156/719 |

(Continued)

*Primary Examiner* — Basil S Katcheves

(74) *Attorney, Agent, or Firm* — GREENBERG TRAURIG, LLP

(57) ABSTRACT

A method includes obtaining a first membrane; obtaining a second membrane; wherein the first and/or second membrane include an uncured silicone edge portion; installing the first membrane above a roofing substrate; installing the second membrane above the roofing substrate; overlapping the first membrane and the second membrane; curing the uncured silicone edge portion; and providing a lap seal between the first membrane and the second membrane.

20 Claims, 7 Drawing Sheets

(56) References Cited

U.S. PATENT DOCUMENTS

| | | | | |
|---|---|---|---|---|
| 2006/0127627 | A1* | 6/2006 | Larson | E04D 5/142 156/289 |
| 2007/0026183 | A1 | 2/2007 | Hubbard | |
| 2010/0200148 | A1 | 8/2010 | Douglas | |
| 2016/0362894 | A1* | 12/2016 | McGraw | E04D 5/142 |
| 2017/0321423 | A1* | 11/2017 | Aschenbeck | E04D 1/29 |
| 2020/0270866 | A1 | 8/2020 | Yancey et al. | |
| 2021/0254343 | A1* | 8/2021 | Zheng | D06M 15/564 |
| 2021/0293026 | A1* | 9/2021 | Chich | E04D 5/145 |
| 2023/0010965 | A1* | 1/2023 | Vega-Gutierrez | E04D 12/00 |

* cited by examiner

ROOFING MEMBRANE AND ASSOCIATED ROOFING SYSTEM AND METHOD

CROSS-REFERENCE TO RELATED APPLICATION

This application relates to and claims the benefit of commonly owned, U.S. Provisional Application Ser. No. 63/518,015, filed on Aug. 7, 2023, entitled "ROOFING MEMBRANE AND ASSOCIATED ROOFING SYSTEM AND METHOD," the contents of which are incorporated herein by reference in their entirety.

FIELD

The present invention is directed to a roofing membrane, and, more specifically, to a roofing membrane installed above a roofing substrate.

BACKGROUND

A known roofing system includes one or more roofing membranes installed above a roofing substrate. A lap seal between two roofing membranes inhibits rainwater, for example, from entering the structure that the roofing substrate covers.

SUMMARY

The Claims, rather than the Summary, define covered embodiments of the present invention. The Summary is a high-level overview of various aspects of the invention and introduces some concepts that are further described in the Detailed Description below. The Summary is not intended to identify key or essential features of the claimed subject matter, and also is not intended to be used in isolation to determine the scope of the claimed subject matter. Instead, the claimed subject matter should be understood by reference to appropriate portions of the Specification and drawings, as well as to each claim.

A device may obtain a first membrane, wherein the first membrane comprises: a bottom layer comprising: a mesh material of polyester, polyether, nylon, cotton or any combination thereof, a top layer, contacting the bottom layer, comprising: a first portion of cured silicone, an edge portion comprising uncured silicone. A device may obtain a second membrane comprising: wherein the second membrane comprises: a bottom layer comprising: a mesh material of polyester, polyether, nylon, cotton or any combination thereof, an edge portion contacting the bottom layer comprising uncured silicone, a top layer, contacting the bottom layer, comprising cured silicone. A device may position the first membrane above a roofing substrate. A device may position the second membrane above the roofing substrate, wherein the second membrane is adjacent to the first membrane. A device may overlap the edge portion of the second membrane over the adjacent edge portion of first membrane to form a lap; and curing the edge portion of the uncured silicone of the second membrane and the edge portion of the uncured silicone of the first membrane, thereby to provide a cured lap seam between the first membrane and the second membrane. In some embodiments, the method comprises: obtaining a first membrane, wherein the first membrane includes: a bottom layer including: a mesh material of polyester, polyether, nylon, cotton or any combination thereof; a top layer, contacting the bottom layer, including: a first portion of cured silicone; an edge portion including uncured silicone; obtaining a second membrane including: wherein the second membrane includes: a bottom layer including: a mesh material of polyester, polyether, nylon, cotton or any combination thereof; an edge portion contacting the bottom layer including uncured silicone; a top layer, contacting the bottom layer, including cured silicone; positioning the first membrane above a roofing substrate; positioning the second membrane above the roofing substrate; wherein the second membrane is adjacent to the first membrane and overlapping the edge portion of the second membrane over the adjacent edge portion of first membrane to form a lap; and curing the edge portion of the uncured silicone of the second membrane and the edge portion of the uncured silicone of the first membrane, thereby to provide a cured lap seam between the first membrane and the second membrane.

In some embodiments, the method includes: removing a film from a surface of the edge portion of the second membrane, to thereby expose the uncured silicone of the edge portion.

In some embodiments, the method includes: at least one of the first membrane and/or the second membrane includes multiple layers.

In some embodiments, an adhesive layer contacts the bottom layer.

In some embodiments, the method, includes: obtaining a first membrane, wherein the first membrane includes: a bottom layer including: a mesh material of polyester, polyether, nylon, cotton or any combination thereof; a top layer, contacting the bottom layer, including: a first portion of cured silicone; an edge portion including uncured silicone; obtaining a second membrane including: wherein the second membrane includes: a bottom layer including: a mesh material of polyester, polyether, nylon, cotton or any combination thereof; a top layer, contacting the bottom layer, including cured silicone; positioning the first membrane above a roofing substrate; positioning the second membrane above the roofing substrate; wherein the second membrane is adjacent to the first membrane and overlapping the edge portion of the first membrane to form a lap; and curing the edge portion of the uncured silicone of the first membrane, thereby to provide a cured lap seam between the first membrane and the second membrane.

In some embodiments, the method includes: removing a film from a surface of the edge portion of the first membrane, to thereby expose the uncured silicone of the edge portion.

In some embodiments, the method includes: at least one of the first membrane and/or the second membrane includes multiple layers.

In some embodiments, the method includes: obtaining a first membrane, wherein the first membrane includes cured silicone; wherein the first membrane includes an edge portion; obtaining a second membrane including: wherein the second membrane includes: a bottom layer including: a mesh material of polyester, polyether, nylon, cotton or any combination thereof; an edge portion contacting the bottom layer including uncured silicone; a top layer, contacting the bottom layer, including cured silicone; positioning the first membrane above a roofing substrate; positioning the second membrane above the roofing substrate; wherein the second membrane is adjacent to the first membrane and overlapping the edge portion of the second membrane over the adjacent edge portion of first membrane to form a lap; and curing the edge portion of the uncured silicone of the second membrane, thereby to provide a cured lap seam between the first membrane and the second membrane.

In some embodiments, the method includes: obtaining a first membrane, wherein the first membrane includes: a bottom layer including: a mesh material of polyester, polyether, nylon, cotton or any combination thereof; a top layer, contacting the bottom layer, including: a first portion of cured silicone; an edge portion including uncured silicone; obtaining a second membrane including: wherein the first membrane includes: a bottom layer including a portion of cured silicone; an edge portion including uncured silicone; a top layer, contacting the bottom layer, including a mesh material of polyester, polyether, nylon, cotton or any combination thereof; positioning the first membrane above a roofing substrate; positioning the second membrane above the roofing substrate; wherein the second membrane is adjacent to the first membrane overlapping the first edge portion of the second membrane over the adjacent edge portion of first membrane to form a lap; and curing the edge portion of the uncured silicone of the second membrane and the edge portion of the uncured silicone of the first membrane, thereby to provide a cured lap seam between the first membrane and the second membrane.

In some embodiments, the second membrane comprises: a mesh material, wherein the first portion comprises the cured silicone embedded in the mesh material, wherein the edge portion comprises the uncured silicone embedded in the mesh material.

In some embodiments, the mesh material comprises at least one of polyester, polyether, nylon, or cotton, and/or combinations thereof.

In some embodiments, the lap seal is water-resistant.

In some embodiments, the lap seal is water-proof.

In some embodiments, the edge portion has a width of 0.5 inches to 12 inches.

In some embodiments, the edge portion has a width of 2 inches to 6 inches.

In some embodiments, at least one of the first membrane and/or the second membrane comprises a self-adhesive layer to adhere to the roofing substrate.

In some embodiments, each of the first membrane and the second membrane comprises a self-adhesive layer to adhere to the roofing substrate.

In some embodiments, neither the first membrane nor the second membrane comprises a self-adhesive layer to adhere to the roofing substrate.

In some embodiments, the method comprises: adhering at least one of the first membrane and/or the second membrane to the roofing substrate after application of an adhesive to the roofing substrate.

In some embodiments, the present invention provides a method, comprising: obtaining a first membrane, wherein the first membrane comprises a first layer, and a loop section adhered to the first membrane, wherein the loop section covers less than an entire surface of the first layer; obtaining a second membrane, wherein the second membrane comprises a second layer, and a hook section adhered to the second layer, wherein the hook section covers less than an entire surface of the second layer; installing the first membrane above a roofing substrate; installing the second membrane above the roofing substrate; and engaging the hook section of the second membrane and the loop section of first membrane, thereby to form a lap seal between the first membrane and the second membrane.

In some embodiments, the engaging comprises covering the second membrane with the first membrane.

In some embodiments, the engaging comprises covering the first membrane with the second membrane.

In some embodiments, at least one of the first membrane and/or the second membrane comprises multiple layers.

In some embodiments, each of the first membrane and the second membrane comprises multiple layers.

In some embodiments, at least one of the first membrane and/or the second membrane comprises a single layer.

In some embodiments, each of the first membrane and the second membrane comprises a single layer.

In some embodiments, the method includes installing one or more additional membranes above the surface of the roofing substrate.

In some embodiments, the lap seal is water-resistant.

In some embodiments, the lap seal is waterproof.

In some embodiments, the method further comprises: applying a liquid coating to the lap seal.

In some embodiments, the liquid coating comprises a silicone.

In some embodiments, at least one of the first membrane and/or the second membrane comprises a self-adhesive layer to adhere to the roofing substrate.

In some embodiments, each of the first membrane and the second membrane comprises a self-adhesive layer to adhere to the roofing substrate.

In some embodiments, neither the first membrane nor the second membrane comprises a self-adhesive layer to adhere to the roofing substrate.

In some embodiments, the method comprises: adhering at least one of the first membrane and/or the second membrane to the roofing substrate after application of an adhesive to the roofing substrate.

In some embodiments, at least one of the first membrane and/or the second membrane comprises at least one of thermoplastic polyolefin, polyvinyl chloride, or modified bitumen.

In some embodiments, each of the first membrane and the second membrane comprises thermoplastic polyolefin, polyvinyl chloride, or modified bitumen.

BRIEF DESCRIPTION OF THE FIGURES

This section refers to the drawings that form a part of this disclosure, and which illustrate some of the embodiments of structure, materials, and/or methods of the present invention described herein.

DETAILED DESCRIPTION

Figure 1A:
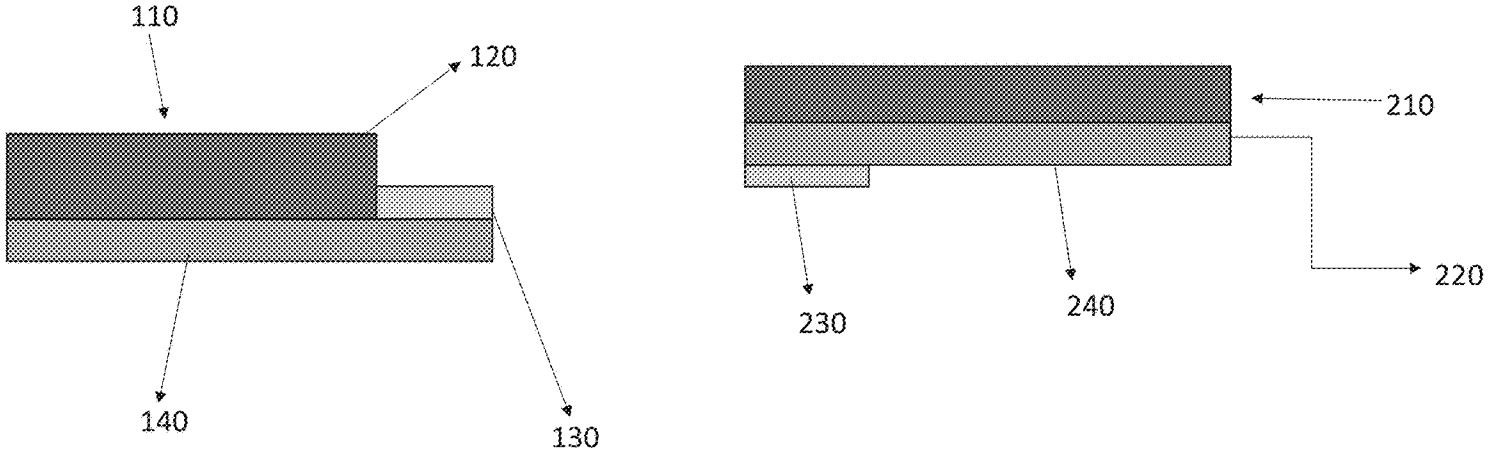
FIG. 1A is a side cross-sectional views of two roofing membranes, in accordance with some embodiments of the invention.

In addition to the benefits and improvements that the Specification discloses, other objects and advantages that the Specification provides will become apparent from the following description taken in conjunction with the accompanying figures. Although the description discloses and describes detailed embodiments of the present disclosure, the disclosed embodiments are merely illustrative of the disclosure that may be embodied in various forms. In addition, each of the examples given regarding the various embodiments of the disclosure are intended to be illustrative, and not restrictive.

In some embodiments, the roofing membrane may be installed on a flat roofing substrate. As used herein, a "flat roofing substrate" is a roofing substrate having a pitch of Y/X, where Y and X are in a ratio of 1:12 or less, where Y corresponds to the "rise" of the roof or roofing substrate, and where X corresponds to the "run" of the roof or roofing substrate.

In some embodiments, the roofing substrate comprises one or more of wood, foam, concrete, metal, and/or one or more other materials, and/or combinations thereof.

In some embodiments, the present invention provides a roofing system and or method. In some embodiments, at least two roofing membranes are installed on or above a roofing substrate, and a lap seal is formed between the membranes. In some embodiments, a lap seal is an overlap seal that is formed by overlapping the membranes and forming a seal between surfaces of the membranes.

In some embodiments, the lap seal is formed by in-situ curing of silicone. In some embodiments, the lap seal is formed by in-situ curing of a portion of one of the first membrane and/or the second membrane. In some embodiments, the lap seal is formed by in-situ curing of a portion of each of the first membrane and the second membrane.

In some embodiments, the first membrane comprises silicone. In some embodiments, the second membrane comprises a first portion and a second portion. In some embodiments, the first portion comprises cured silicone. In some embodiments, the edge portion comprises uncured silicone. In some embodiments, the first membrane is installed on or above a roofing substrate. In some embodiments, the second membrane is installed on or above the roofing substrate. In some embodiments, the edge portion of the second membrane overlaps at least a portion of the first membrane. In some embodiments, the edge portion of the second membrane is cured, thereby to provide the lap seal between the first membrane and the second membrane. As used herein, the term "cured" refers to an at least partially crosslinked polymeric material.

In some embodiments, the first membrane covers the second membrane that is, the first membrane is above the second membrane above the roofing substrate. In some embodiments, the second membrane covers the first membrane—that is, the second membrane is above the first membrane above the roofing substrate.

In some embodiments, a removable protective film covers a surface of either or both the first portion of the first membrane and/or the edge portion of the second membrane. In some embodiments, the protective film is removed, thereby to expose the uncured silicone of the edge portion. In some embodiments, the exposed second portion of the second membrane overlaps the first membrane. In some embodiments, the first membrane overlaps the exposed second portion of the second membrane. In some embodiments, the edge portion of the second membrane is cured, thereby to provide the lap seal between the first membrane and the second membrane.

In some embodiments, one or both of the first membrane and the second membrane comprises a single layer. In some embodiments, one or both of the first membrane and the second membrane comprises multiple layers.

In some embodiments, one or both of the first membrane and the second membrane comprises a mesh material. In some embodiments, the first portion of the second membrane comprises the cured silicone embedded in the mesh material. In some embodiments, the edge portion comprises the uncured silicone embedded in the mesh material. In some embodiments, embedded means that the silicone is disposed within openings in the mesh material.

In some embodiments, the mesh material comprises at least one of polyester, polyether, nylon, and/or cotton, and/or combinations thereof.

In some embodiments, one or both of the first membrane and/or the second membrane comprises thermoplastic polyolefin, polyvinyl chloride, and/or modified bitumen, and/or combinations thereof.

In some embodiments, the lap seal is a water-resistant seal. In some embodiments, the lap seal is a water-proof seal.

In some embodiments, one or both of the first membrane and/or the second membrane comprises additives, such as by not limited to a stabilizer, antioxidant, colorant, nucleating agent, mold release agent, dispersing agent, UV light absorber, UV light reflector, IR light absorber, IR light reflector, flame retardant, mold release agent, dye, pigment, antistatic additive, and/or one or more other additives, and/or combinations thereof.

In some embodiments, the silicone layer has a thickness of 10 mils. In some embodiments, the silicone layer has a thickness of 11 mils. In some embodiments, the silicone layer has a thickness of 12 mils. In some embodiments, the silicone layer has a thickness of 13 mils. In some embodiments, the silicone layer has a thickness of 14 mils. In some embodiments, the silicone layer has a thickness of 15 mils. In some embodiments, the silicone layer has a thickness of 16 mils. In some embodiments, the silicone layer has a thickness of 17 mils. In some embodiments, the silicone layer has a thickness of 18 mils. In some embodiments, the silicone layer has a thickness of 19 mils. In some embodiments, the silicone layer has a thickness of 20 mils. In some embodiments, the silicone layer has a thickness of 21 mils. In some embodiments, the silicone layer has a thickness of 22 mils. In some embodiments, the silicone layer has a thickness of 23 mils. In some embodiments, the silicone layer has a thickness of 24 mils. In some embodiments, the silicone layer has a thickness of 25 mils.

In some embodiments, the first membrane and/or second membrane has a thickness of more than 10 mils. In some embodiments, the first membrane and/or second membrane has a thickness of more than 11 mils. In some embodiments, the first membrane and/or second membrane has a thickness of more than 12 mils. In some embodiments, the first membrane and/or second membrane has a thickness of more than 13 mils. In some embodiments, the first membrane and/or second membrane has a thickness of more than 14 mils. In some embodiments, the first membrane and/or second membrane has a thickness of more than 15 mils. In some embodiments, the first membrane and/or second membrane has a thickness of more than 16 mils. In some embodiments, the first membrane and/or second membrane has a thickness of more than 17 mils. In some embodiments, the first membrane and/or second membrane has a thickness of more than 18 mils. In some embodiments, the first membrane and/or second membrane has a thickness of more than 19 mils. In some embodiments, the first membrane and/or second membrane has a thickness of more than 20 mils. In some embodiments, the first membrane and/or second membrane has a thickness of more than 21 mils. In some embodiments, the first membrane and/or second membrane has a thickness of more than 22 mils. In some embodiments, the first membrane and/or second membrane has a thickness of more than 23 mils. In some embodiments, the first membrane and/or second membrane has a thickness of more than 24 mils. In some embodiments, the first membrane and/or second membrane has a thickness of more than 25 mils.

In some embodiments, the first membrane and/or second membrane has a thickness of 10 to 25 mils. In some embodiments, the first membrane and/or second membrane has a thickness of 15 to 25 mils.

In some embodiments, either or both of the first membrane and/or the second membrane comprises a self-adhesive layer to adhere to the roofing substrate. In some embodiments, either or both of the first membrane and/or the second membrane comprises a self-adhesive layer to adhere to the roofing substrate, and a removable protective film or release liner covering the self-adhesive layer. In some embodiments, the self-adhesive layer comprises a pressure-sensitive adhesive (PSA). In some embodiments, the self-adhesive layer comprises at least one of an asphaltic adhesive, a butyl adhesive, a silicone adhesive, an epoxy adhesive, a polyurethane adhesive, an acrylic adhesive, or any combination thereof. In some embodiments, the protective film comprises at least a polymer. In some embodiments, the protective film comprises a silicone. In some embodiments, the protective film comprises a silicone coating, which allows removal of the protective film from the adhesive.

In some embodiments, either or both of the first membrane and/or the second membrane adhere to the roofing substrate after application of an adhesive to the roofing substrate. In some embodiments, either or both of the first membrane and/or the second membrane consists of an adhesive layer that cover at least a portion of the bottom surface of either or both of the first membrane and/or the second membrane. In some embodiments, the adhesive comprises at least one of acrylic, polyurethan, silicone, rubber, asphalt, polymer, and combinations thereof. In some embodiments, the adhesive, may be rolled, brushed, and/or sprayed on the roofing substrate.

In some embodiments, the edge portion that comprises uncured silicone extends along a width of the roofing membrane—e.g., along a direction that is parallel to an axis about which the roofing membrane is rolled when on a roll. In some embodiments, the edge portion that comprises uncured silicone extends along a length of the roofing membrane—e.g., along a direction that is perpendicular to an axis about which the roofing membrane is rolled when on a roll. In some embodiments, the first portion that comprises cured silicone extends along the length of the roofing membrane along one edge of roofing membrane, and the edge portion that comprises uncured silicone extends along the length of the roofing membrane along an opposite edge of roofing membrane.

In some embodiments, the present invention provides a hook section on one roofing membrane, and a loop section on another roofing membrane, and a lap seal is formed by engaging the hook section and the loop section.

In some embodiments, the first membrane comprises a first layer. In some embodiments, the first membrane comprises a loop section adhered to the first layer. In some embodiments, the loop section covers less than an entire surface of the first layer.

In some embodiments, the second membrane comprises a second layer. In some embodiments, the second membrane comprises a hook section adhered to the second layer. In some embodiments, the hook section covers less than an entire surface of the second layer.

In some embodiments, the first membrane covers the second membrane—that is, the first membrane is above the second membrane. In some embodiments, the second membrane covers the first membrane—that is, the second membrane is above the first membrane.

In some embodiments, at least one of the first membrane and/or the second membrane comprises multiple layers. In some embodiments, each of the first membrane and the second membrane comprises multiple layers. In some embodiments, multiple layers means that the membrane comprises two layer, three layers, four layers, five layers, six layer, or more than six layers.

In some embodiments, at least one of the first membrane and/or the second membrane comprises a single layer. In some embodiments, each of the first membrane and the second membrane comprises a single layer.

In some embodiments, the lap seal is a water-resistant seal. In some embodiments, the lap seal is a water-proof seal.

In some embodiments, the hook section and/or the loop section extends along a width of the roofing membrane— e.g., along a direction that is parallel to an axis about which the roofing membrane is rolled when on a roll. In some embodiments, the hook section and/or the loop section extends along a length of the roofing membrane—e.g., along a direction that is perpendicular to an axis about which the roofing membrane is rolled when on a roll. In some embodiments, the roofing membrane includes. In some embodiments, the hook section extends along the length of the roofing membrane along one edge of roofing membrane, and the loop section extends along the length of the roofing membrane along an opposite edge of roofing membrane.

In some embodiments, a liquid coating is applied to the lap seal. In some embodiments, the liquid coating comprises silicone. In some embodiments, the silicone comprises uncured silicone. In some embodiments, the liquid coating is cured. In some embodiments, the liquid coating dries. In some embodiments, it is not until the liquid coating is applied, cures, and/or dries that the lap seal is a water-resistant seal. In some embodiments, it is not until the liquid coating is applied, cures, and/or dries that the lap seal is a water-proof seal.

As shown in the FIG. 1A, in accordance with some embodiments of the invention, the first membrane 110 and/or second membrane 210 may include a first portion comprising cured silicone 120 and 220 respectively, and a second portion that comprises uncured silicone 130 and 230 respectively.

In some embodiments, a protective film or release layer may be removed from the first and second portion of the membranes, thereby exposing the uncured silicone 120 and 220. In some embodiments, the first membrane 110 and/or second membrane 210 includes the first portion comprising cured silicone, and the edge portion comprising uncured silicone. In some embodiments, both first membrane 110 and the second membrane 220 may include a first portion comprising cured silicone, and a second portion comprising uncured silicone. In some embodiments, either or both first membrane 110 and/or the second membrane 220 may be thinner at an end thereof, such that an upper surface formed by overlapping the first membrane 110 and the second membrane 220 may be a continuous flat or substantially flat surface.

In some embodiments, as shown in FIG. 1A, the first membrane 110 and the second membrane 210 comprise a mesh material 140 and 240 respectively, wherein the first portion comprises the cured silicone embedded in the mesh material, wherein the edge portion comprises the uncured silicone embedded in the mesh material. In some embodiments, the mesh material comprises at least one of polyester, polyether, nylon, or cotton, and/or combinations thereof.

Figure 1B:
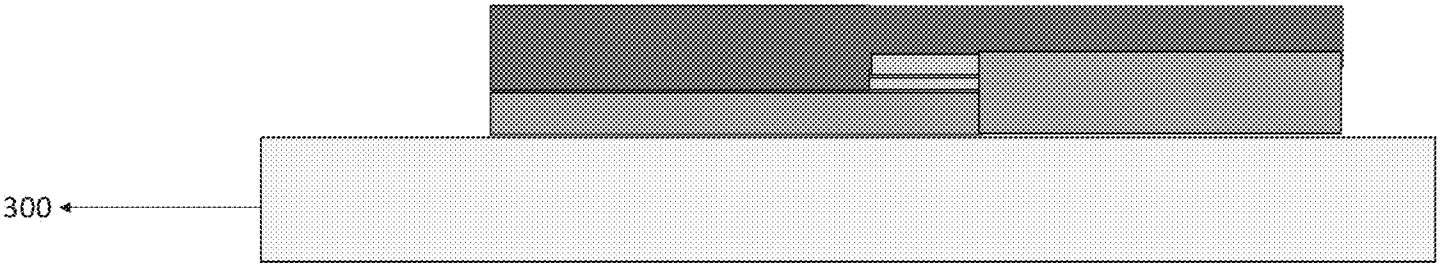
FIG. 1B is a side cross-sectional views of a roofing system including the two roofing membranes of FIG. 1A installed above a roofing substrate where a lap seal is formed between the membranes, in accordance with some embodiments of the invention.

In some embodiments, as shown in FIG. 1B, after installation by overlapping the second membrane 210 on the first membrane 110 above the roofing substrate 300, the uncured silicone of the edge portion of the second membrane 210 and the uncured silicone of the first portion of the first membrane 110 are cured, thereby forming a lap seal 310 between the first membrane 110 and the second membrane 210, as described. In some embodiments, either the first membrane 110 or the second membrane 210 includes an uncured silicone portion and, after installation, the uncured silicone is cured forming a lap seal. As described, in some embodiments, the lap seal is coated with an additional coating. In some embodiments, the lap seal may be water-resistant, or waterproof.

Figure 1C:
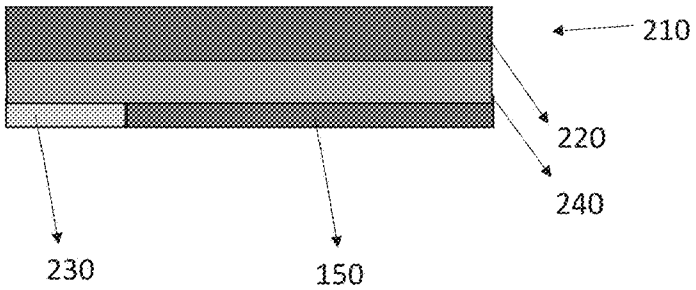
FIG. 1C is a side cross-sectional views of two roofing membranes, in accordance with some embodiments of the invention.
Figure 1C:
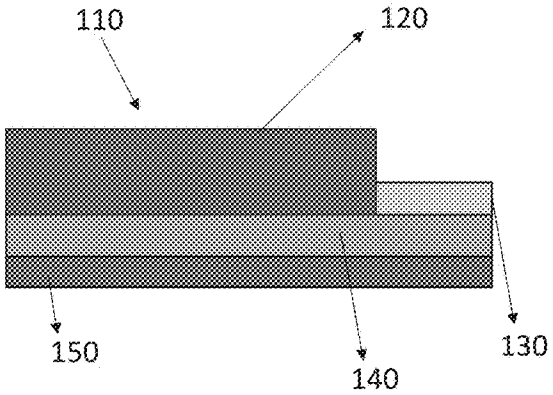
Figure 1D:
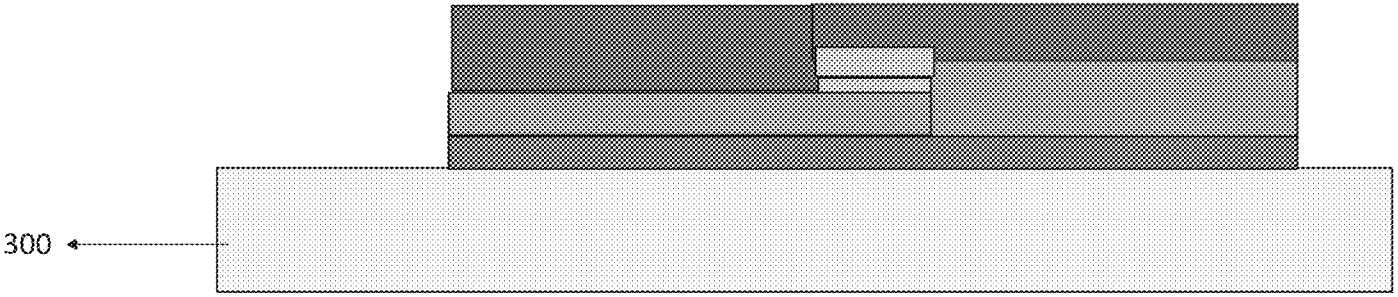
FIG. 1D is a side cross-sectional views of a roofing system including the two roofing membranes of FIG. 1C installed above a roofing substrate where a lap seal is formed between the membranes, in accordance with some embodiments of the invention.

In some embodiments, as shown in FIGS. 1C and 1D, either or both of the first membrane and/or the second membrane, illustrated in FIGS. 1A and 1B, consists of an adhesive layer 150 that cover at least a portion of the bottom surface of either or both of the first membrane and/or the second membrane and adheres the membranes to the roof substate 300.

Figure 1E:
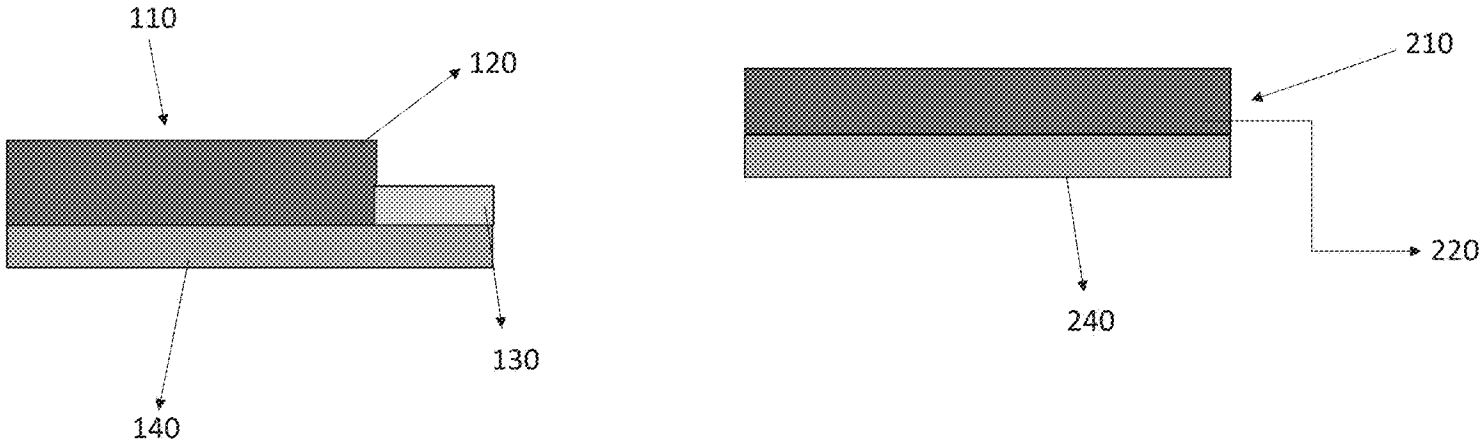
FIG. 1E is a side cross-sectional views of two roofing membranes, in accordance with some embodiments of the invention.

As shown in the FIG. 1E, in accordance with some embodiments of the invention, the first membrane 110 and/or second membrane 210 may include a first portion comprising cured silicone 120 and 220 respectively, and the first membrane includes a second portion that comprises uncured silicone 130. In some embodiments, as shown in FIG. 1E, the first membrane 110 and the second membrane 210 comprise a mesh material 140 and 240 respectively, wherein the first portion of the first membrane comprises the cured silicone embedded in the mesh material, wherein the edge portion of the first membrane comprises the uncured silicone embedded in the mesh material.

Figure 1F:
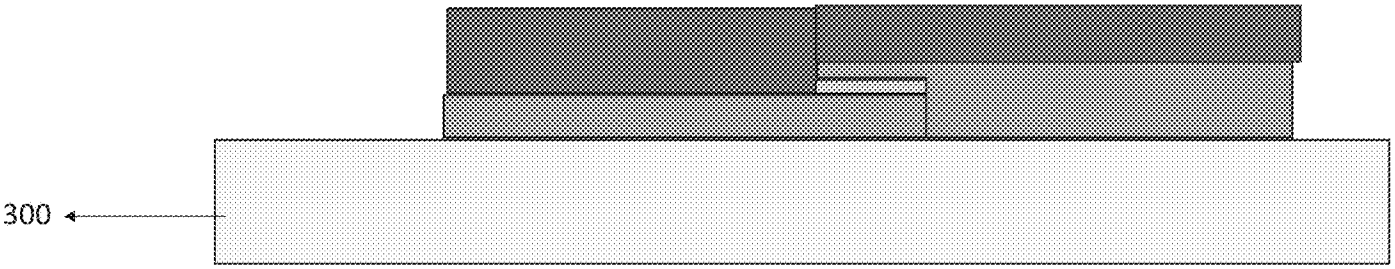
FIG. 1F is a side cross-sectional views of a roofing system including the two roofing membranes of FIG. 1E installed above a roofing substrate where a lap seal is formed between the membranes, in accordance with some embodiments of the invention.

In some embodiments, as shown in FIG. 1F, after installation by overlapping the second membrane 210 on the first membrane 110 above the roofing substrate 300, the uncured silicone of the first portion of the first membrane 110 is cured, thereby forming a lap seal 310 between the first membrane 110 and the second membrane 210, as described. As described, in some embodiments, the lap seal is coated with an additional coating. In some embodiments, the lap seal may be water-resistant, or waterproof.

Figure 1G:
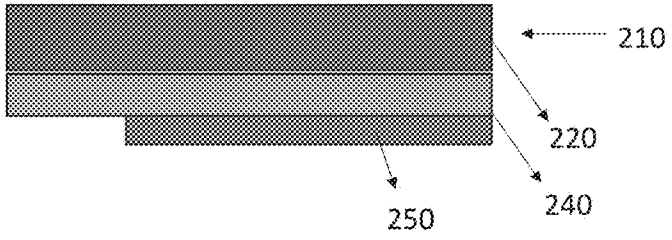
FIG. 1G is a side cross-sectional views of two roofing membranes, in accordance with some embodiments of the invention.
Figure 1G:
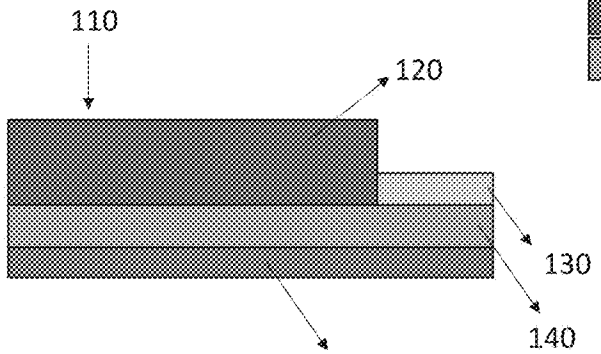
Figure 1H:
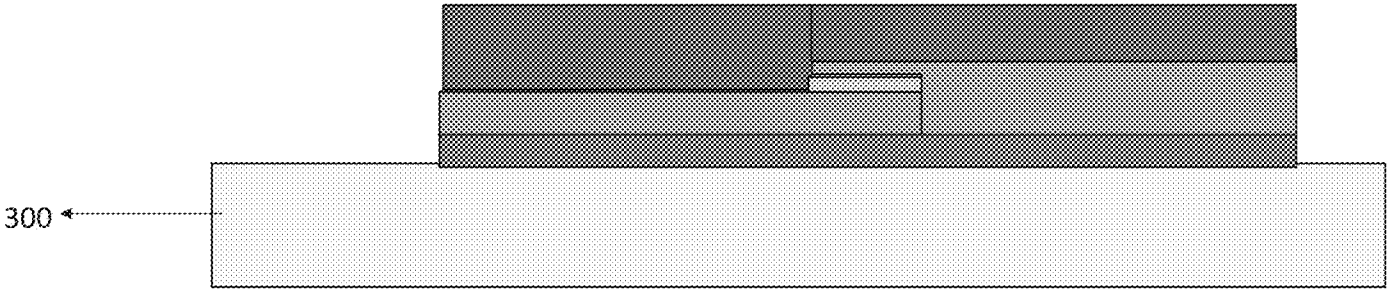
FIG. 1H is a side cross-sectional views of a roofing system including the two roofing membranes of FIG. 1G installed above a roofing substrate where a lap seal is formed between the membranes, in accordance with some embodiments of the invention.

In some embodiments, as shown in FIGS. 1G and 1H, either or both of the first membrane and/or the second membrane, illustrated in FIGS. 1E and 1F, consists of an adhesive layer 150 and 250 that cover at least a portion of the bottom surface of either or both of the first membrane and/or the second membrane.

Figure 1I:
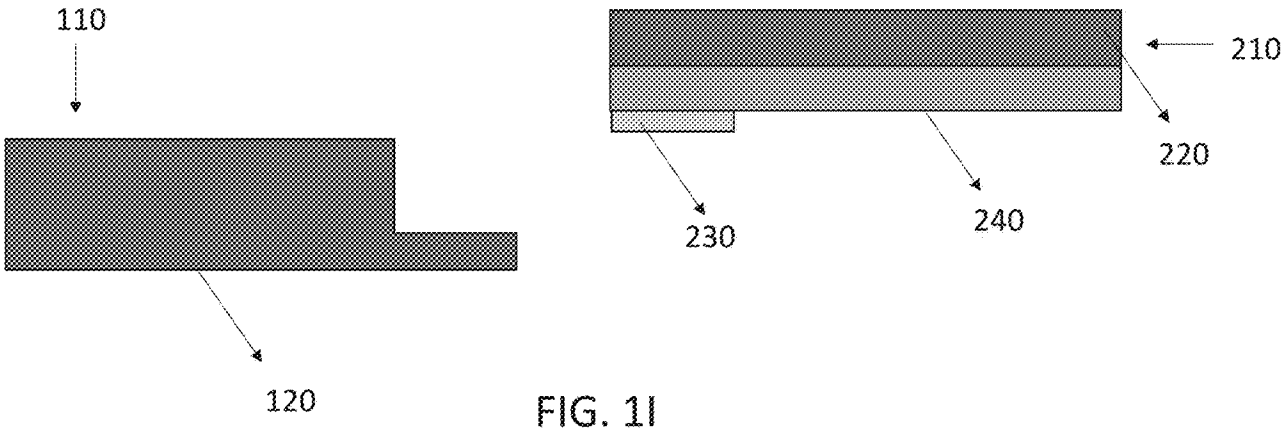
FIG. 1I is a side cross-sectional views of two roofing membranes, in accordance with some embodiments of the invention.

As shown in the FIG. 1I, in accordance with some embodiments of the invention, the first membrane 110 and/or second membrane 210 may include a first portion comprising cured silicone 120 and 220 respectively, and the second membrane 210 includes a second portion that comprises uncured silicone 230. In some embodiments, as shown in FIG. 1I, the second membrane 210 comprises a mesh material 240, wherein the first portion of the second membrane comprises the cured silicone embedded in the mesh material, wherein the edge portion of the second membrane comprises the uncured silicone embedded in the mesh material.

Figure 1J:
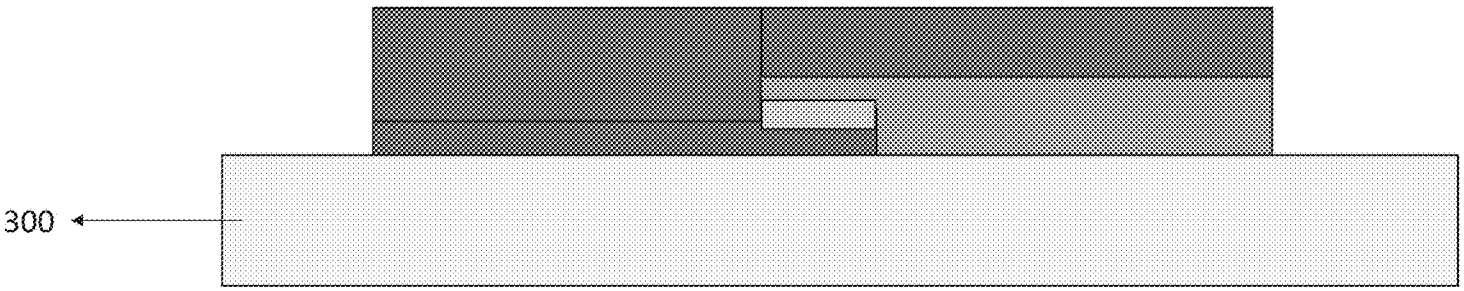
FIG. 1J is a side cross-sectional views of a roofing system including the two roofing membranes of FIG. 1I installed above a roofing substrate where a lap seal is formed between the membranes, in accordance with some embodiments of the invention.

In some embodiments, as shown in FIG. 1J, after installation by overlapping the second membrane 210 on the first membrane 110 above the roofing substrate 300, the uncured silicone of the edge portion of the second membrane 210 is cured, thereby forming a lap seal 310 between the first membrane 110 and the second membrane 210, as described. As described, in some embodiments, the lap seal is coated with an additional coating. In some embodiments, the lap seal may be water-resistant, or waterproof.

Figure 1K:
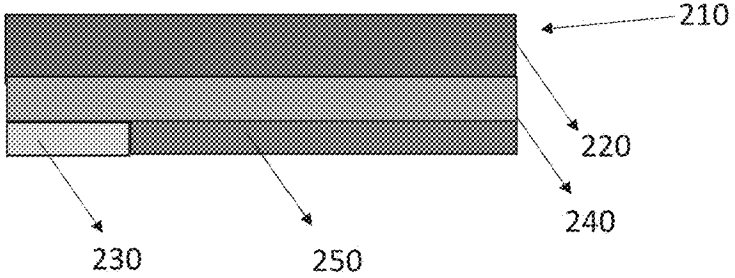
FIG. 1K is a side cross-sectional views of two roofing membranes, in accordance with some embodiments of the invention.
Figure 1K:
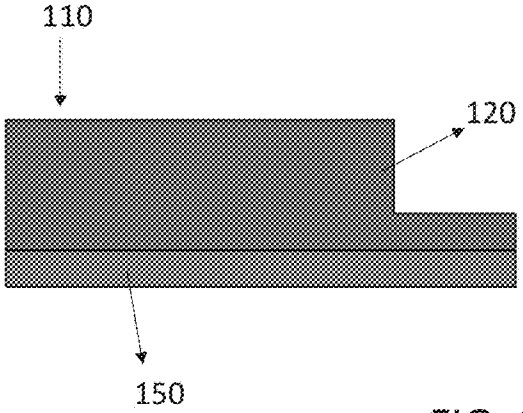
Figure 1L:
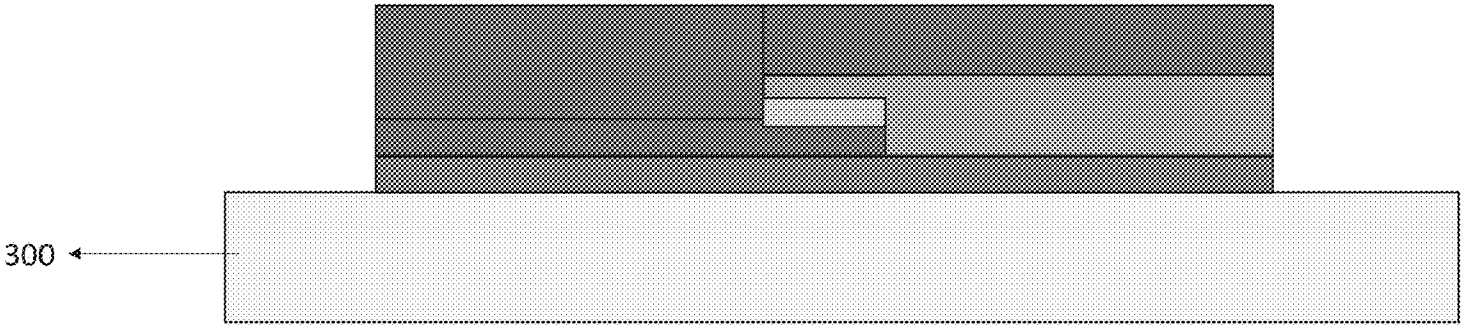
FIG. 1L is a side cross-sectional views of a roofing system including the two roofing membranes of FIG. 1L installed above a roofing substrate where a lap seal is formed between the membranes, in accordance with some embodiments of the invention.

In some embodiments, as shown in FIGS. 1K and 1L, either or both of the first membrane and/or the second membrane, illustrated in FIGS. 11 and 1J, consists of an adhesive layer 150 and 250 that cover at least a portion of the bottom surface of either or both of the first membrane and/or the second membrane.

In some embodiments, the first membrane and the second membrane are similar roofing membranes, in that each roofing membrane includes a first portion comprises cured silicone along one edge thereof, and a second portion comprising uncured silicone along an opposite edge thereof.

In some embodiments, the first membrane and the second membrane are different roofing membranes, in that either the first membrane or the second membrane includes a first portion comprises cured silicone along one edge thereof, and a second portion comprising uncured silicone along an opposite edge thereof.

In some embodiments, the first membrane and the second membrane are different roofing membranes, in that either the first membrane or the second membrane comprise a mesh material, wherein the first portion comprises the cured silicone embedded in the mesh material, wherein the edge portion comprises the uncured silicone embedded in the mesh material. In some embodiments, the mesh material comprises at least one of polyester, polyether, nylon, or cotton, and/or combinations thereof.

In some embodiments, a protective film or release layer may be removed from the edge portion of the membrane, thereby exposing the uncured silicone 230. In some embodiments, either or both first membrane 110 and/or the second membrane 220 may be thinner at an end thereof, such that an upper surface formed by overlapping the first membrane 110 and the second membrane 220 may be a continuous flat or substantially flat surface.

In some embodiments, not shown, the second membrane 210 overlaps the first membrane 110. In some embodiments, however, the first membrane 110 overlaps the second membrane 210. In some embodiment, one or both first membrane 110 and/or the second membrane 210 may be a single-layer membrane. In some embodiment, one or both first membrane 110 and/or the second membrane 220 may be a multiple-layer membrane. In some embodiments, the roofing system includes more than two membranes—that is, more that the first membrane 110 and the second membrane 210 installed above the roofing substrate 300.

In some embodiments, not shown, after installation by overlapping the second membrane 210 on the first membrane 110 above the roofing substrate 300, the uncured silicone of the edge portion of the second membrane 210 is cured, thereby forming a lap seal 310 between the first membrane 110 and the second membrane 210, as described. In some embodiments, either the first membrane 110 or the second membrane 210 includes an uncured silicone portion and, after installation, the uncured silicone is cured forming a lap seal. As described, in some embodiments, the lap seal is coated with an additional coating. In some embodiments, the lap seal may be water-resistant, or waterproof.

In some embodiments, the uncured silicone portion is applied in the factory. In some embodiments, the uncured silicone portion is applied at the job site (i.e., in the field).

In some embodiments, the adhesive portion is applied in the factory. In some embodiments, the adhesive portion is applied at the job site (i.e., in the field).

In some embodiments, for nested overlaps, the first membrane includes a reinforcement exposed and facing up. Uncured silicone is applied to the reinforcement of the first membrane and the opposite edge of the second membrane with the reinforcement of the second membrane facing toward the roof substate.

In some embodiments, the edge portion comprising uncured silicone has a width of 0.2 inches. In some embodiments, the edge portion has a width of 0.3 inches. In some embodiments, the edge portion has a width of 0.4 inches. In some embodiments, the edge portion has a width of 0.5 inches. In some embodiments, the edge portion has a width of 1 inch. In some embodiments, the edge portion has a width of 2 inches. In some embodiments, the edge portion has a width of 3 inches. In some embodiments, the edge portion has a width of 4 inches. In some embodiments, the edge portion has a width of 5 inches. In some embodiments, the edge portion has a width of 6 inches. In some embodiments, the edge portion has a width of 7 inches. In some embodiments, the edge portion has a width of 8 inches. In some embodiments, the edge portion has a width of 9 inches. In some embodiments, the edge portion has a width of 10 inches. In some embodiments, the edge portion has a width of 11 inches. In some embodiments, the edge portion has a width of 12 inches. In some embodiments, the edge portion has a width of 13 inches. In some embodiments, the edge portion has a width of 14 inches. In some embodiments, the edge portion has a width of 15 inches. In some embodiments, the edge portion has a width of 16 inches. In some embodiments, the edge portion has a width of 17 inches. In some embodiments, the edge portion has a width of 18 inches.

In some embodiments, the edge portion has a width of greater than 0.2 inches. In some embodiments, the edge portion has a width of greater than 0.3 inches. In some embodiments, the edge portion has a width of greater than 0.4 inches. In some embodiments, the edge portion has a width of greater than 0.5 inches. In some embodiments, the edge portion has a width of greater than 1 inch. In some embodiments, the edge portion has a width of greater than 2 inches. In some embodiments, the edge portion has a width of greater than 3 inches. In some embodiments, the edge portion has a width of greater than 4 inches. In some embodiments, the edge portion has a width of greater than 5 inches. In some embodiments, the edge portion has a width of greater than 6 inches. In some embodiments, the edge portion has a width of greater than 7 inches. In some embodiments, the edge portion has a width of greater than 8 inches. In some embodiments, the edge portion has a width of greater than 9 inches. In some embodiments, the edge portion has a width of greater than 10 inches. In some embodiments, the edge portion has a width of greater than 11 inches. In some embodiments, the edge portion has a width of greater than 12 inches. In some embodiments, the edge portion has a width of greater than 13 inches. In some embodiments, the edge portion has a width of greater than 14 inches. In some embodiments, the edge portion has a width of greater than 15 inches. In some embodiments, the edge portion has a width of greater than 16 inches. In some embodiments, the edge portion has a width of greater than 17 inches. In some embodiments, the edge portion has a width of greater than 18 inches.

In some embodiments, the edge portion has a width of 0.2 inches to 18 inches. In some embodiments, the edge portion has a width of 1 inch to 18 inches. In some embodiments, the edge portion has a width of 2 inches to 18 inches. In some embodiments, the edge portion has a width of 6 inches to 18 inches. In some embodiments, the edge portion has a width of 12 inches to 18 inches.

In some embodiments, the edge portion has a width of 0.2 inches to 17 inches. In some embodiments, the edge portion has a width of 1 inch to 17 inches. In some embodiments, the edge portion has a width of 2 inches to 17 inches In some embodiments, the edge portion has a width of 8 inches to 17 inches.

In some embodiments, the edge portion has a width of 0.2 inches to 16 inches. In some embodiments, the edge portion has a width of 1 inch to 16 inches. In some embodiments, the edge portion has a width of 8 inches to 16 inches. In some embodiments, the edge portion has a width of 0.2 inches to 15 inches. In some embodiments, the edge portion has a width of 1 inch to 15 inches. In some embodiments, the edge portion has a width of 8 inches to 15 inches. In some embodiments, the edge portion has a width of 0.2 inches to 14 inches. In some embodiments, the edge portion has a width of 1 inch to 14 inches. In some embodiments, the edge portion has a width of 8 inches to 14 inches. In some embodiments, the edge portion has a width of 0.2 inches to 13 inches. In some embodiments, the edge portion has a width of 1 inch to 13 inches. In some embodiments, the edge portion has a width of 2 inches to 13 inches. In some embodiments, the edge portion has a width of 8 inches to 13 inches. In some embodiments, the edge portion has a width of 9 inches to 13 inches. In some embodiments, the edge portion has a width of 10 inches to 13 inches. In some embodiments, the edge portion has a width of 0.2 inches to 12 inches. In some embodiments, the edge portion has a width of 1 inch to 12 inches. In some embodiments, the edge portion has a width of 6 inches to 12 inches. In some embodiments, the edge portion has a width of 0.2 inches to 11 inches. In some embodiments, the edge portion has a width of 1 inch to 11 inches. In some embodiments, the edge portion has a width of 5 inches to 11 inches. In some embodiments, the edge portion has a width of 0.2 inches to 10 inches. In some embodiments, the edge portion has a width of 1 inch to 10 inches. In some embodiments, the edge portion has a width of 5 inches to 10 inches. In some embodiments, the edge portion has a width of 0.2 inches to 9 inches. In some embodiments, the edge portion has a width of 1 inch to 9 inches. In some embodiments, the edge portion has a width of 5 inches to 9 inches. In some embodiments, the edge portion has a width of 0.2 inches to 8 inches. In some embodiments, the edge portion has a width of 1 inch to 8 inches. In some embodiments, the edge portion has a width of 2 inches to 8 inches. In some embodiments, the edge portion has a width of 4 inches to 8 inches. In some embodiments, the edge portion has a width of 0.2 inches to 7 inches. In some embodiments, the edge portion has a width of 1 inch to 7 inches. In some embodiments, the edge portion has a width of 0.2 inches to 6 inches. In some embodiments, the edge portion has a width of 1 inch to 6 inches. In some embodiments, the edge portion has a width of 0.2 inches to 5 inches. In some embodiments, the edge portion has a width of 1 inch to 5 inches. In some embodiments, the edge portion has a width of 0.2 inches to 4 inches. In some embodiments, the edge portion has a width of 1 inch to 4 inches. In some embodiments, the edge portion has a width of 0.2 inches to 3 inches. In some embodiments, the edge portion has a width of 1 inch to 3 inches. In some embodiments, the edge portion has a width of 0.2 inches to 2 inches. In some embodiments, the edge portion has a width of 1 inch to 2 inches.

In some embodiments, the overlap between the first membrane and the second membrane is the width of the edge portions. In some embodiments, the overlap between the first membrane and the second membrane is greater than the width of the edge portions. In some embodiments, the overlap between the first membrane and the second membrane is less than the width of the edge portions.

In some embodiments, the overlap is 0.2 inches. In some embodiments, the overlap is 0.3 inches. In some embodiments, the overlap is 0.4 inches. In some embodiments, the overlap is 0.5 inches. In some embodiments, the overlap is 1 inch. In some embodiments, the overlap is 2 inches. In some embodiments, the overlap is 3 inches. In some embodiments, the overlap is 4 inches. In some embodiments, the overlap is 5 inches. In some embodiments, the overlap is 6 inches. In some embodiments, the overlap is 7 inches. In some embodiments, the overlap is 8 inches. In some embodiments, the overlap is 9 inches. In some embodiments, the overlap is 10 inches. In some embodiments, the overlap is 11 inches. In some embodiments, the overlap is 12 inches. In some embodiments, the overlap is 13 inches. In some embodiments, the overlap is 14 inches. In some embodiments, the overlap is 15 inches. In some embodiments, the overlap is 16 inches. In some embodiments, the overlap is 17 inches. In some embodiments, the overlap is 18 inches.

Figure 2:
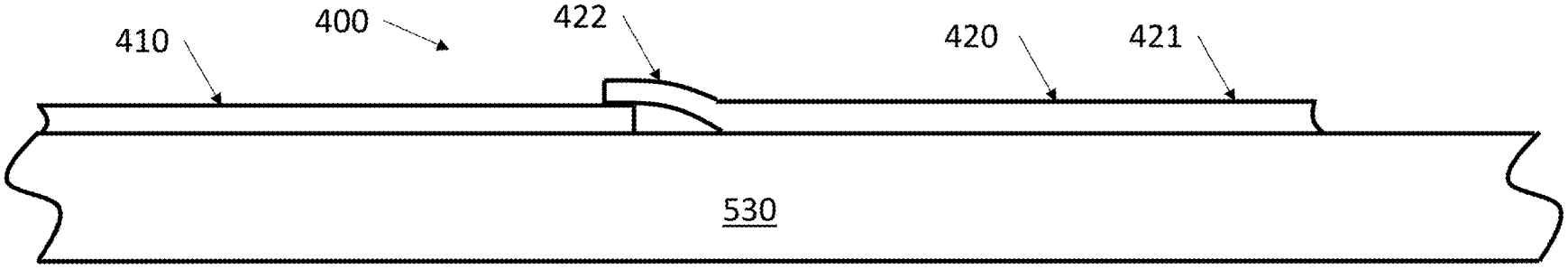
FIG. 2 is a side cross-sectional view of a roofing system including two roofing membranes installed above a roofing substrate, in accordance with some embodiments of the invention.

With reference to the drawings, FIG. 2 is a side cross-sectional view of a roofing system including two roofing membranes installed above a roofing substrate, in accordance with some embodiments of the invention. As shown, in some embodiments, the roofing system 400 includes at least a first membrane 410 and a second membrane 420, installed above a roofing substrate 430. As previously described, in some embodiments, either or both, or neither, of the first membrane 410 and/or the second membrane 420 includes a self-adhesive layer (e.g., a pressure-sensitive adhesive), and/or is adhered to the roofing substrate by an adhesive applied (e.g., rolled, sprayed, and/or brushed) to the roofing substrate 430.

Figure 3:
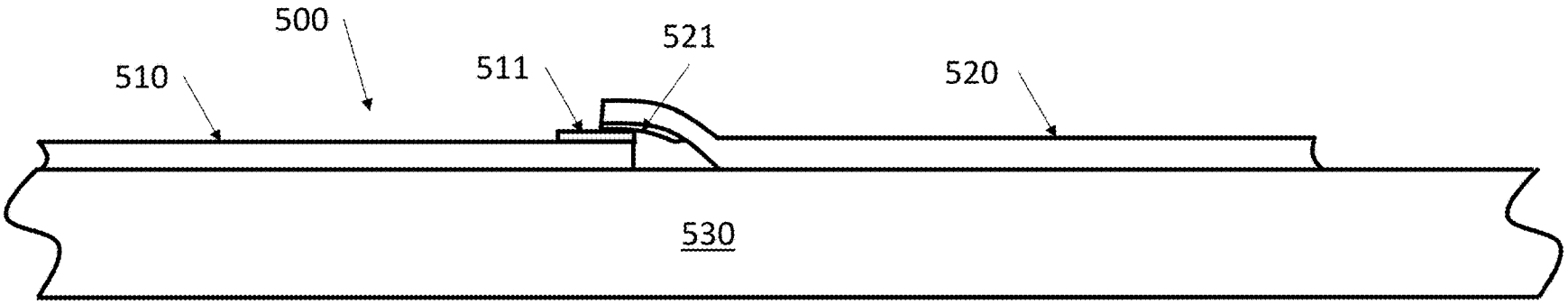
FIG. 3 is a side cross-sectional view of a roofing system including two roofing membranes installed above a roofing substrate, in accordance with some embodiments of the invention.

FIG. 3 is a side cross-sectional view of another roofing system including two roofing membranes installed above a roofing substrate, in accordance with some embodiments of the invention. As shown, in some embodiments, the roofing system 500 includes at least a first membrane 510 and a second membrane 520, installed above a roofing substrate 530. Thus, as previously described, in some embodiments, either or both, or neither, of the first membrane 510 and/or the second membrane 520 includes a self-adhesive layer (e.g., a pressure-sensitive adhesive), and/or is adhered to the roofing substrate by an adhesive applied (e.g., rolled, sprayed, and/or brushed) to the roofing substrate 530.

Any or all of the first membrane 510, the second membrane 520, and/or the roofing substrate 530 may be as described herein. For example, as shown in the figure, in accordance with some embodiments of the invention, the first membrane 510 and the second membrane 520 may include cooperating hook-and-loop fasteners (e.g., a hook section on one membrane, and a loop section on the other membrane). In some embodiments, as shown, one or both of the hook section and/or the loop section covers less than an entire surface of membrane.

In some embodiments, the first membrane 510 may include a first one of the hook-and-loop type fasteners 511 (e.g., a hook section), and the second membrane 520 may include a second one of the hook-and-loop type fasteners 521 (e.g., a loop section). In some embodiments, the first membrane 510 may include a first one of the hook-and-loop type fasteners 511 (e.g., a loop section), and the second membrane 520 may include a second one of the hook-and-loop type fasteners 521 (e.g., a section portion). In some embodiments, either or both of the first membrane 510 and/or the second membrane 520 may be thinner at an end thereof, such that an upper surface formed by overlapping the first membrane 510 and the second membrane 520 may be a continuous flat or substantially flat surface.

In some embodiments, as shown in the drawings, the second membrane 520 overlaps the first membrane 510. In some embodiments, the first membrane 510 overlaps the second membrane 520. In some embodiment, one or both of the first membrane 510 and/or the second membrane 520 may be a single-layer membrane. In some embodiment, one or both of the first membrane 510 and/or the second membrane 520 may be a multiple-layer membrane. In some embodiments, the roofing system 500 includes more than two membranes—that is, more that the first membrane 510 and the second membrane 520 installed above the roofing substrate 530.

In some embodiments, after installation of the first membrane 510 and the second membrane 520 above the roofing substrate 530, the hoop-and-loop fasteners are engaged, thereby forming a lap seal between the first membrane 510 and the second membrane 520, as described. As described, in some embodiments, the lap seal is coated with an additional coating, such as, for example, silicone, which is then cured. In some embodiments, the lap seal may be water-resistant, or waterproof, before application of the additional coating. In some embodiments, the lap seal may be water-resistant, or waterproof after application of the additional coating.

As described, in some embodiments, the first membrane 510 and the second membrane 520 are similar roofing membranes, in that each roofing membrane includes a hook section along one edge thereof, and a loop section along an opposite edge thereof.

In some embodiments, the method of installation comprises: obtaining a first membrane, wherein the first membrane comprises a first layer, and a loop section adhered to the first membrane, wherein the loop section covers less than an entire surface of the first layer; obtaining a second membrane, wherein the second membrane comprises a second layer, and a hook section adhered to the second layer, wherein the hook section covers less than an entire surface of the second layer; installing the first membrane above a roofing substrate; installing the second membrane above the roofing substrate; and engaging the hook section of the second membrane and the loop section of first membrane, thereby to form a lap seal between the first membrane and the second membrane.

As discussed above, in some embodiments of the invention, the present invention includes any and all of the membranes, the roofing system including one or more of the membranes installed above the roofing substrate, and/or a method, such as a method of installing the membranes, which comprises obtaining one or more of the components of the roofing system, and installing the components above the roofing substrate, as described.

In some embodiments of the invention, any of the shown and described roofing membranes, and any of the above-discussed variations, may be provided in the form or a roll, in the form of a sheet, or in another form.

Variations, modifications, and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

What is claimed is:

1. A method comprising:
obtaining a first membrane,
wherein the first membrane comprises:
a bottom layer comprising:
a mesh material comprising at least one of polyester, polyether, nylon, cotton, or any combination thereof;
a top layer comprising:
a first portion of a cured silicone;
an edge portion comprising an uncured silicone,
wherein the edge portion directly contacts the bottom layer;
obtaining a second membrane,
wherein the second membrane comprises:
a bottom layer comprising:
a mesh material comprising at least one of polyester, polyether, nylon, cotton, or any combination thereof;
a top layer, contacting the bottom layer, comprising a cured silicone; and
an uncured silicone layer,
wherein the uncured silicone layer is located on a surface of an edge portion of the bottom layer;
installing the first membrane on a roofing substrate;
installing the second membrane on the roofing substrate;
wherein the second membrane is adjacent to the first membrane;
wherein the uncured silicone layer of the second membrane overlaps the adjacent edge portion of the first membrane to form a lap; and
curing the uncured silicone layer of the second membrane and the uncured silicone of the edge portion of the first membrane, thereby to provide a cured lap seam between the first membrane and the second membrane.

2. The method of claim 1, wherein the cured silicone of the top layer of the second membrane is embedded in the mesh material of the bottom layer of the second membrane.

3. The method of claim 1, wherein the uncured silicone layer is embedded in the mesh material of the bottom layer of the second membrane.

4. The method of claim 1, further comprising:
removing a film from a surface of the uncured silicone layer of the second membrane, to thereby expose the uncured silicone layer.

5. The method of claim 1, wherein at least one of the first membrane, the second membrane, or any combination thereof comprises multiple layers.

6. The method of claim 1, wherein an adhesive layer contacts the bottom layer of at least one of the first membrane, the second membrane, or any combination thereof.

7. The method of claim 6, wherein the adhesive layer comprises at least one of an acrylic, a polyurethane, a silicone, a rubber, an asphalt, a polymer, or any combination thereof.

8. The method of claim 1, wherein at least one of the first membrane, second membrane, or any combination thereof has a thickness of 10 to 25 mils.

9. A method comprising:
obtaining a first membrane,
wherein the first membrane comprises:
a bottom layer comprising:
a mesh material comprising at least one of polyester, polyether, nylon, cotton, or any combination thereof;
a top layer comprising:
a first portion comprising a cured silicone;
an edge portion comprising an uncured silicone;
obtaining a second membrane,
wherein the second membrane comprises:
a bottom layer comprising:
a mesh material comprising at least one of polyester, polyether, nylon, cotton, or any combination thereof;
a top layer comprising a cured silicone;
installing the first membrane on a roofing substrate;
installing the second membrane on the roofing substrate;

wherein the second membrane is adjacent to the first membrane;

wherein an edge portion of the second membrane overlaps the adjacent edge portion of the first membrane to form a lap; and curing the uncured silicone of the edge portion of the first membrane, thereby to provide a cured lap seam between the first membrane and the second membrane.

10. The method of claim 9, wherein the cured silicone of the top layer of the first membrane is embedded in the mesh material of the bottom layer of the first membrane.

11. The method of claim 9, wherein the uncured silicone of the top layer of the first membrane is embedded in the mesh material of the bottom layer of the first membrane.

12. The method of claim 9, further comprising:

removing a film from a surface of the edge portion of the first membrane, to thereby expose the uncured silicone of the edge portion.

13. The method of claim 9, wherein at least one of the first membrane, the second membrane, or any combination thereof comprises multiple layers.

14. The method of claim 9, wherein an adhesive layer contacts the bottom layer of at least one of the first membrane, the second membrane, or any combination thereof.

15. The method of claim 14, wherein the adhesive layer comprises at least one of an acrylic, a polyurethane, a silicone, a rubber, an asphalt, a polymer, and any combination thereof.

16. A method comprising:

obtaining a first membrane, wherein the first membrane comprises a cured silicone;

wherein the first membrane comprises an edge portion;

obtaining a second membrane, wherein the second membrane comprises:

a bottom layer comprising:

a mesh material comprising at least one of polyester, polyether, nylon, cotton, or any combination thereof;

a top layer, contacting the bottom layer, comprising a cured silicone;

an uncured silicone layer, wherein the uncured silicone layer is located on a surface of an edge portion of the bottom layer;

installing the first membrane on a roofing substrate;

installing the second membrane on the roofing substrate;

wherein the second membrane is adjacent to the first membrane and wherein the uncured silicone layer of the second membrane overlaps the adjacent edge portion of the first membrane to form a lap; and curing the uncured silicone layer of the second membrane, thereby to provide a cured lap seam between the first membrane and the second membrane.

17. The method of claim 16, further comprising:

removing a film from a surface of the uncured silicone layer of the second membrane, to thereby expose the uncured silicone layer.

18. The method of claim 16, wherein at least one of the first membrane, the second membrane, or any combination thereof comprises multiple layers.

19. The method of claim 16, wherein an adhesive layer contacts the bottom layer of at least one of the first membrane, the second membrane, or any combination thereof.

20. The method of claim 19, wherein the adhesive layer comprises at least one of an acrylic, a polyurethane, a silicone, a rubber, an asphalt, a polymer, or any combination thereof.

* * * * *